US005669795A

United States Patent [19]

Lahtinen

[11] Patent Number: 5,669,795

[45] Date of Patent: Sep. 23, 1997

[54] LIFE-SAVING FLOAT

[76] Inventor: Mikko Petteri Lahtinen, Kirstinharju 1 B 16, FIN-02760 Espoo, Finland

[21] Appl. No.: 522,358

[22] PCT Filed: Mar. 15, 1994

[86] PCT No.: PCT/FI94/00097

§ 371 Date: Sep. 13, 1995

§ 102(e) Date: Sep. 13, 1995

[87] PCT Pub. No.: WO94/21513

PCT Pub. Date: Sep. 29, 1994

[30] Foreign Application Priority Data

Mar. 15, 1993 [FI] Finland ..... 931131

[51] Int. Cl.[6] ..... B63C 9/08

[52] U.S. Cl. ..... 441/88; 441/93; 441/117

[58] Field of Search ..... 441/12, 80, 88, 441/89, 90, 92, 93, 101, 106, 108, 111, 113, 117

[56] References Cited

U.S. PATENT DOCUMENTS

| | | | |
|---|---|---|---|
| 2,701,886 | 2/1955 | Ivie . | |
| 3,127,624 | 4/1964 | Kubit et al. . | |
| 3,144,667 | 8/1964 | Dobbs | 441/93 |
| 3,510,895 | 5/1970 | Wynne . | |
| 3,975,785 | 8/1976 | Stadeker . | |
| 4,560,356 | 12/1985 | Burr . | |
| 5,030,152 | 7/1991 | Carr et al. | 441/89 |
| 5,037,341 | 8/1991 | Howard . | |
| 5,106,236 | 4/1992 | Hancock et al. | 441/89 |

FOREIGN PATENT DOCUMENTS

| | | |
|---|---|---|
| 24 45 357 | of 1981 | Germany . |
| WO85/00570 | 2/1985 | WIPO . |

*Primary Examiner*—Stephen Avila

*Attorney, Agent, or Firm*—Nath & Associates; Gary M. Nath; Suet M. Chong

[57] ABSTRACT

The present invention relates to a life float. The life float comprises a stretching capsule and a string or cord starting at the ends thereof, arranged to pass around over a shoulder and under an arm. The watertight capsule consists of a part resembling a test tube and a cap in the shape of a test tube bottom. The inside of the capsule includes a float to be filled, a small gas capsule and a pricking mechanism therebetween for the gas capsule, a pressure reducer, an air vale, and a whistle. The capsule is to be placed close to the chest so that a person can reach it with his hands. When needing the float, the person catches the capsule and pushes it further off from his/her body. Hereby, the cap of the watertight capsule opens, owing to the pulling movement caused by thread 1, and the threads pull the entire float out. The rest of the inside remains within the capsule. As the float is extracted, the mechanism pricks the gas container, thus making the float to be filled. The fill-in gas passes through the loud whistle. When the float is filled, the string on the shoulder can also be passed under the arm.

4 Claims, 2 Drawing Sheets

41
A
B
C
F

42
Fx

43
F
a 44
b
F
45

46

47

LIFE-SAVING FLOAT

The present invention relates to a life float, comprising a small elongated capsule which can with the aid of a link held with a hand close to the chest of a person so that the link has been passed over a shoulder and under an arm from behind, said capsule being provided with a gas container wherewith the fill-in float included in the life float can be filled.

Floats intended for life saving purposes and filled with a small gas container have long been known in the art. A means of this type is known in the U.S. Pat. No. 3,633,230. However, in said means the float to be filled remains constantly unprotected. In addition, the filling of the float is started by pressing a trigger, which releases a stressed spring. To be fastened on, the apparatus also needs a secure locking system. Said means is intended to be passed around the neck.

A state of art drawback in said fillable float is that it is constantly subjected to damages when placed outdoors. Hence, the float may leak and be useless in a critical situation. In addition, the winding of the means around the neck may cause a risk of strangling. And bursting the pressure container and filling of the float happens near a person's body (for instance, in a means placed close to the carotid artery), which in a disturbance may have grave results. Also finding the trigger in an emergency situation can be difficult. On the other hand, unnecessary filling of the float is not unusual, either. Furthermore, if a float to be filled has somehow been wound before being filled, it may cause a danger of strangling in the course of filling or otherwise obstruct the movements. The means is also provided with a "triggering spring" in stressed mode before adopting the float into use, which is not a sustainable solution. The secure locking system when being fastened on also adds the manufacturing costs. And putting on the means is relatively difficult.

The objective of the present invention is to provide a means intended for life saving in which the above disadvantages have been eliminated. The aim is achieved with a means according to claim 1.

The invention is described below in detail referring to the accompanying drawing.

FIG. 1 presents the cap of a capsule and the way it is attached to the capsule.

Figure 1:
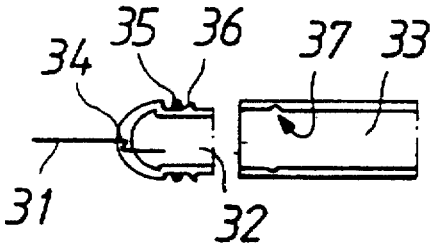
Figure 2:
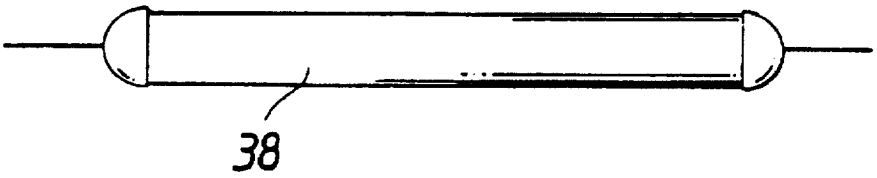
FIG. 2 shows the parts within the capsule and particularly the functioning of the threads.
Figure 3:
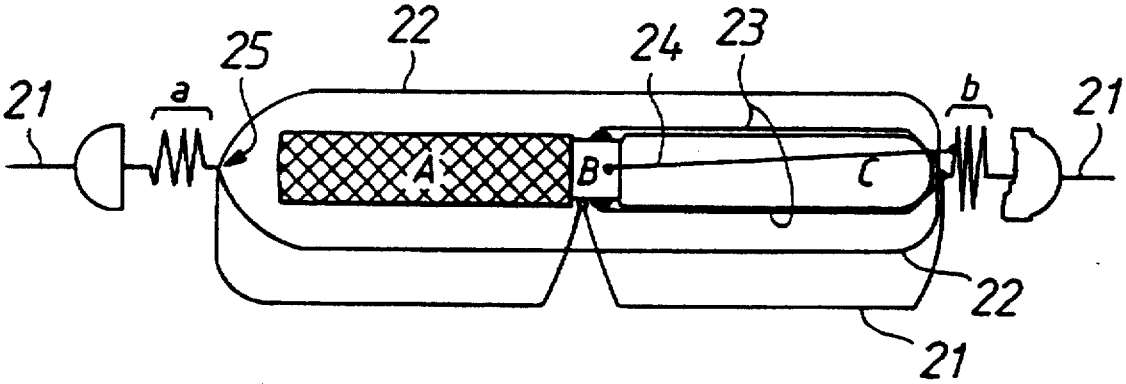
FIG. 3 illustrates the region between the gas capsule and the float to be filled.
Figure 3:
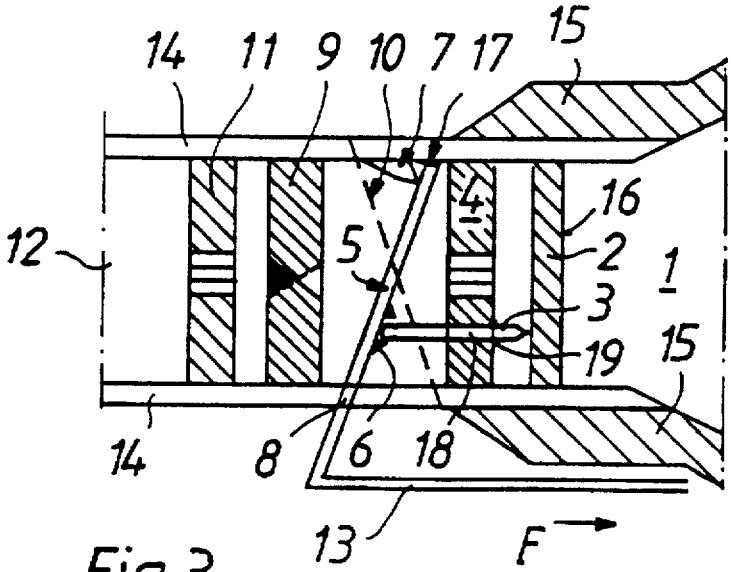
Figures 4A, 4B, 4C, 4D, 4E, 4F:
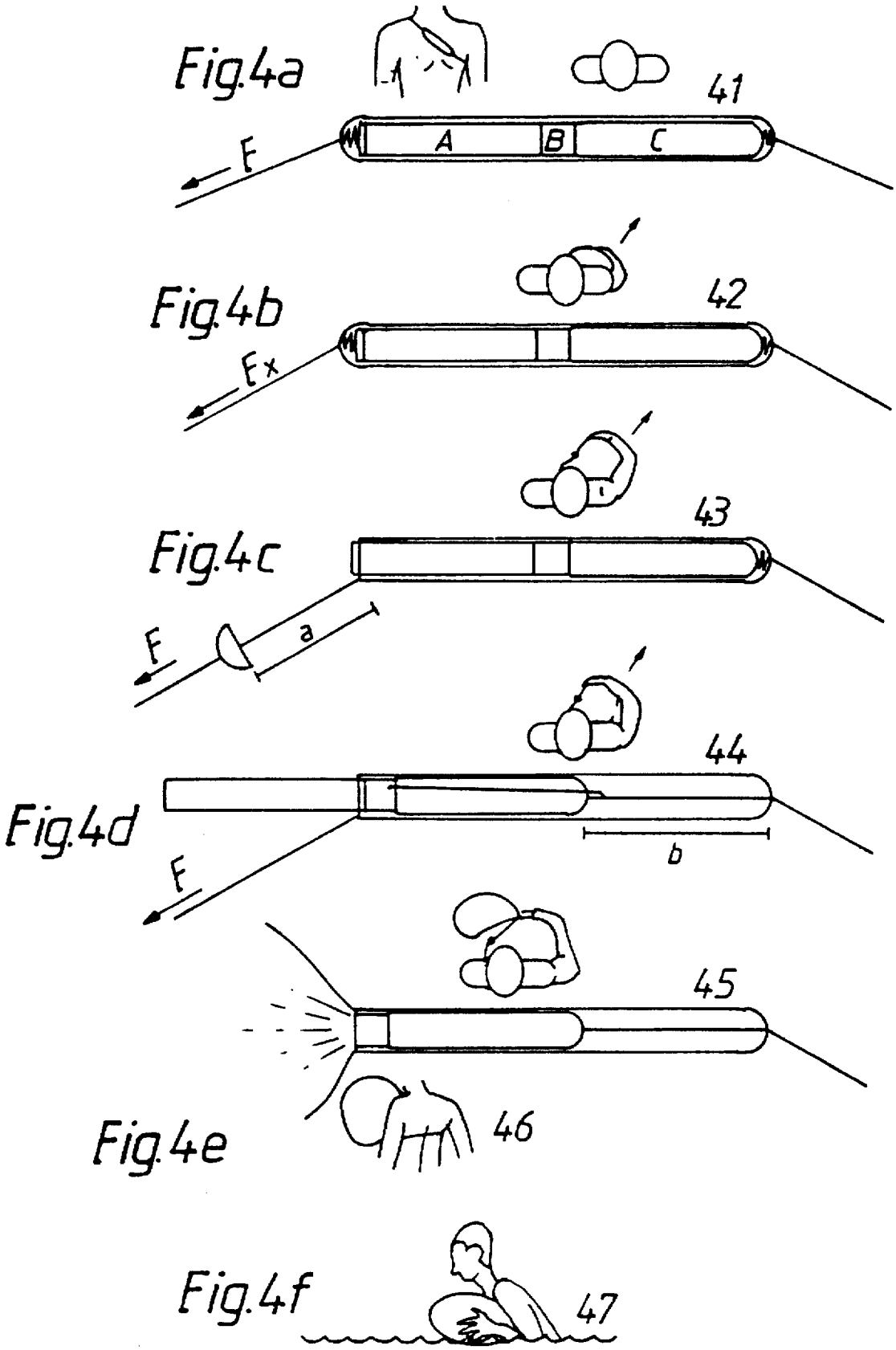

FIGS. *4a–4f* show the use of a life float capsule.

FIG. 1

The capsule has been sealed to be watertight so that the parts thereinside remain reliable in operation. The cap of the capsule resembles the bottom of a test tube in shape. The cap is provided with an 0 seal ring and thereafter, an annular bulge. The capsule is provided with a countergroove for said bulge. This system keeps the cap solidly in place, sealing it tight. A main thread runs sealedly in the middle of the cap, and a remover of pull-out is provided within the cap to reduce the penetration stress of the thread. Point 38 shows a closed capsule.

FIG. 2

The main thread within the cap of the capsule is to some extent loose a, (the reason thereto being that the cap is enabled to move aside for extracting the float, but if the pull-out force of the string has only been a "peak", and not intended, the cap can be inserted back in the capsule, with the purpose that the main thread 21 is easier to be pass over one shoulder when the float has been filled). Thereafter, the main thread 21 is provided with a joint 25 from which two out-pulling threads 22 start, being combined behind the gas capsule C. After the cap has been pulled off and the loose a is finished, the pull-out threads 22 start to pull the inside out. After the float A has been pulled out entirely, the pricking thread 24 of the gas container is stressed, thus starting the filling. Thereafter, the loose b of the thread ends, thus stopping the extraction of the inner parts.

The gas container C has been connected to part B with a support frame 23 withstanding the pulling from part B caused by pressure reduction. Part B seals the path between the gas container C and the float A, thus maintaining the float securely fast in the body. Part B forms an extension to the float A to be filled, that is, parts A and B have already originally been produced either to be integral or they have been glued, or in one way or another attached to each other closely.

FIG. 3

When a sufficient pull has been achieved in the pricking thread 13, the rod 5 starts to move when the outer shell 14 compresses because of the elasticity thereof (left of borderline 10). The rod 5 is not allowed to move out of its place because of blocks 7 and 17. The rod starts to push the pricking spike 3 which in turn remains in the right place due to block 6. The pricking spike penetrates first the protection layer 2, then the shell 16 of the gas capsule. The protection layer 2 serves as a sheltering structure and the pricking spike 3 is enabled to penetrate it only when the force F is sufficient (not false force).

After the spike has penetrated the shell of the gas capsule, the pressure of the gas pushes the spike backwards. Thanks to the block 19 in the spike, the motion of the spike stops. In this manner, the pricking mechanism is again in the initial position.

The pressure of the gas emitting out of the container 1 is reduced in an air choke 4, whereafter the gas passes through a valve 9 (valves, if for the sake of safety there are two floats provided), permitting the gas to flow in one direction only, whereafter the gas travels through a whistle 11 making a loud sound, whereafter the gas enters the float to be filled. The means B has been attached to the gas capsule with a support frame 15. The support frame is required to be firm enough to withstand pressure reduction. At point 8 the rod 5 has been brought close to the outer shell 14. Point 18 is required to be as well sealed as possible. Point 10 has been assumed to form the border between the elastic and the hard matter. The left side of the borderline 10 is elastic and the right side is hard.

FIG. 4

At 41 the life float is placed upon a person. The life float is provided with a capsule and a stretch cord/thread starts at the ends thereof passing under the arms and over the shoulder. The thread is so tight that it will not create any disturbance so that the capsule is not allowed to swing. The capsule is a straight tube with the ends of the shape of a test tube bottom. The design enables the person to move without obstructions. When the life float is needed (point 42), the person catches the capsule and pushes it off from his/her body so that the thread 21 is tightened. After the force exceeds a given level, one end of the capsule opens. From the inside of the capsule the float to be filled (point 43) is discharged, whereafter the gas capsule is pricked through (point 44). Now, the filling of the float may start (point 45 Ä). The fill-in gas flows first through an air choke which reduces the pressure of the gas, whereafter the gas travels through the whistle making a loud sound. When the air bag is filled (point 46), the main thread can be fitted to pass round also over the other shoulder and under the arms. Thus, the life float keeps the person above the water surface (point 47).

The invention is not limited to the accompanying embodiment, and a great number of modifications are conceivable within the scope of the idea defined by the claims enclosed. The gas container may, for instance, be positioned fixedly in a protection capsule, so that the structure of the gas container is similar to that of a gas-filled cigarette lighter.

I claim:

1. A life float, comprising:

a small capsule with a removable end, said capsule having therein a fill-in float, a gas inflating means coupled to said fill-in float for inflating said fill-in float, wherein said gas inflating means comprises a gas container having a sealing film which in use is burst by a pricking mechanism whereby gas is enabled to flow to said fill-an float, and a triggering means for triggering said gas inflating means to inflate .said fill-in float, said triggering means comprising said pricking mechanism and said triggering means located between the gas container and the float; and a link means coupled to and extended through said capsule forming a circular link such that a predetermined pressure exerted on said link means pulls said fill-in float from said capsule and triggers said triggering means thereby causing said fill-in float to be inflated, said link means configured such that in use said link means can encircle a user by being passed over a shoulder and under one arm behind the back to keep said capsule close to the chest of a user so that said capsule can be reached with a hand of the user and further serving as a fastening link passed under the arms to keep the inflated fill-in float close to the chest.

2. Life float according to claim 1, characterized in that associated with the gas container a loud whistle is provided, making a great noise when the gas flows therethrough.

3. Life float according to claim 2, characterized in that within the capsule is provided a pull-out mechanism for the capsule, to pull the inside of the capsule so far out that the float is completely discharged before it is filled with gas.

4. Life float according to claim 3, characterized in that the pricking of the fill-in gas container is performed at a distance from the body of a user.

* * * * *